US008998108B2

(12) United States Patent
Hsieh

(10) Patent No.: US 8,998,108 B2
(45) Date of Patent: Apr. 7, 2015

(54) SPRINKLER APPARATUS

(71) Applicant: Pai-Chou Hsieh, Chang-Hua County (TW)

(72) Inventor: Pai-Chou Hsieh, Chang-Hua County (TW)

(73) Assignee: Yung Pin Industrial Co., Ltd., Chang-Hua County (CN)

( * ) Notice: Subject to any disclaimer, the term of this patent is extended or adjusted under 35 U.S.C. 154(b) by 95 days.

(21) Appl. No.: 13/901,626

(22) Filed: May 24, 2013

(65) Prior Publication Data

US 2014/0346249 A1 Nov. 27, 2014

(51) Int. Cl.

| | |
|---|---|
| ***B05B 3/16*** | (2006.01) |
| ***B05B 3/14*** | (2006.01) |
| ***B05B 15/06*** | (2006.01) |
| ***B05B 1/14*** | (2006.01) |

(52) U.S. Cl.

CPC ..... *B05B 15/063* (2013.01)

(58) Field of Classification Search

CPC ..... B05B 3/044; B05B 3/14; B05B 3/16; B05B 1/20; B05B 15/066; B05B 15/067

USPC ..... 239/225.1, 237, 240, 242, 273, 566, 239/581.1, 600

See application file for complete search history.

(56) References Cited

U.S. PATENT DOCUMENTS

| | | | | | |
|---|---|---|---|---|---|
| 3,115,305 | A * | 12/1963 | Rinkewich | ..... | 239/242 |
| 3,286,929 | A * | 11/1966 | Henningsen | ..... | 239/242 |
| 3,332,624 | A * | 7/1967 | Rinkewich | ..... | 239/242 |
| 3,423,024 | A * | 1/1969 | Morawetz | ..... | 239/242 |
| 3,578,248 | A * | 5/1971 | Congdon et al. | ..... | 239/242 |
| 4,721,248 | A * | 1/1988 | Chow | ..... | 239/242 |
| 4,877,185 | A * | 10/1989 | Kufrin | ..... | 239/242 |
| 5,735,462 | A * | 4/1998 | Roman | ..... | 239/242 |
| 6,568,603 | B2 * | 5/2003 | Chao | ..... | 239/242 |

* cited by examiner

*Primary Examiner* — Darren W Gorman

(74) *Attorney, Agent, or Firm* — Alan D. Kamrath; Kamrath IP Lawfirm, P.A.

(57) ABSTRACT

A sprinkler apparatus includes a sprinkler and a frame for supporting the sprinkler. The frame includes two lateral members and first and second cross members. Each of the first and second cross members includes two lateral edges each connected to a corresponding one of the lateral members. The lateral members and the first and second cross members are made of metal by punching.

13 Claims, 3 Drawing Sheets

SPRINKLER APPARATUS

BACKGROUND OF INVENTION

1. Field of Invention

The present invention relates to gardening and, more particularly, to a light and inexpensive sprinkler apparatus for gardening.

2. Related Prior Art

A conventional sprinkler apparatus includes a sprinkler and a frame for supporting the sprinkler on the ground or, sometimes, a wall. The conventional frame is made of metal by casting and inevitable finishing, such as grinding or sandblasting. The amount of metal used to make the conventional frame is large. Hence, the conventional frame is heavy. The casting requires molds and is complicated and expensive. The finishing further adds to the cost of the conventional frame. Furthermore, the conventional frame is aesthetically dull, because it is difficult for it to carry coatings.

The present invention is therefore intended to obviate or at least alleviate the problems encountered in the prior art.

SUMMARY OF INVENTION

It is the primary objective of the present invention to provide a light, inexpensive and aesthetically pleasant sprinkler apparatus.

To achieve the foregoing objective, the sprinkler apparatus includes a sprinkler and a frame for supporting the sprinkler. The frame includes two lateral members and first and second cross members. Each of the first and second cross members includes two lateral edges each connected to a corresponding one of the lateral members. The lateral members and the first and second cross members are made of metal by punching.

In another aspect, the first and second cross members are secured to the lateral members by welding.

In still another aspect, each of the lateral members includes first and second slots. The first cross member includes a fin extending from each of the lateral edges thereof. The second cross member includes a fin extending from each of the lateral edges thereof. Each of the fins of the first cross member is inserted in the first slot of a corresponding one of the lateral member. Each of the fins of the second cross member is inserted in the second slot of a corresponding one of the lateral members.

Other objectives, advantages and features of the present invention will be apparent from the following description referring to the attached drawings.

BRIEF DESCRIPTION OF DRAWINGS

The present invention will be described via detailed illustration of the preferred embodiments referring to the drawings wherein.

DETAILED DESCRIPTION OF PREFERRED EMBODIMENTS

Figure 1:
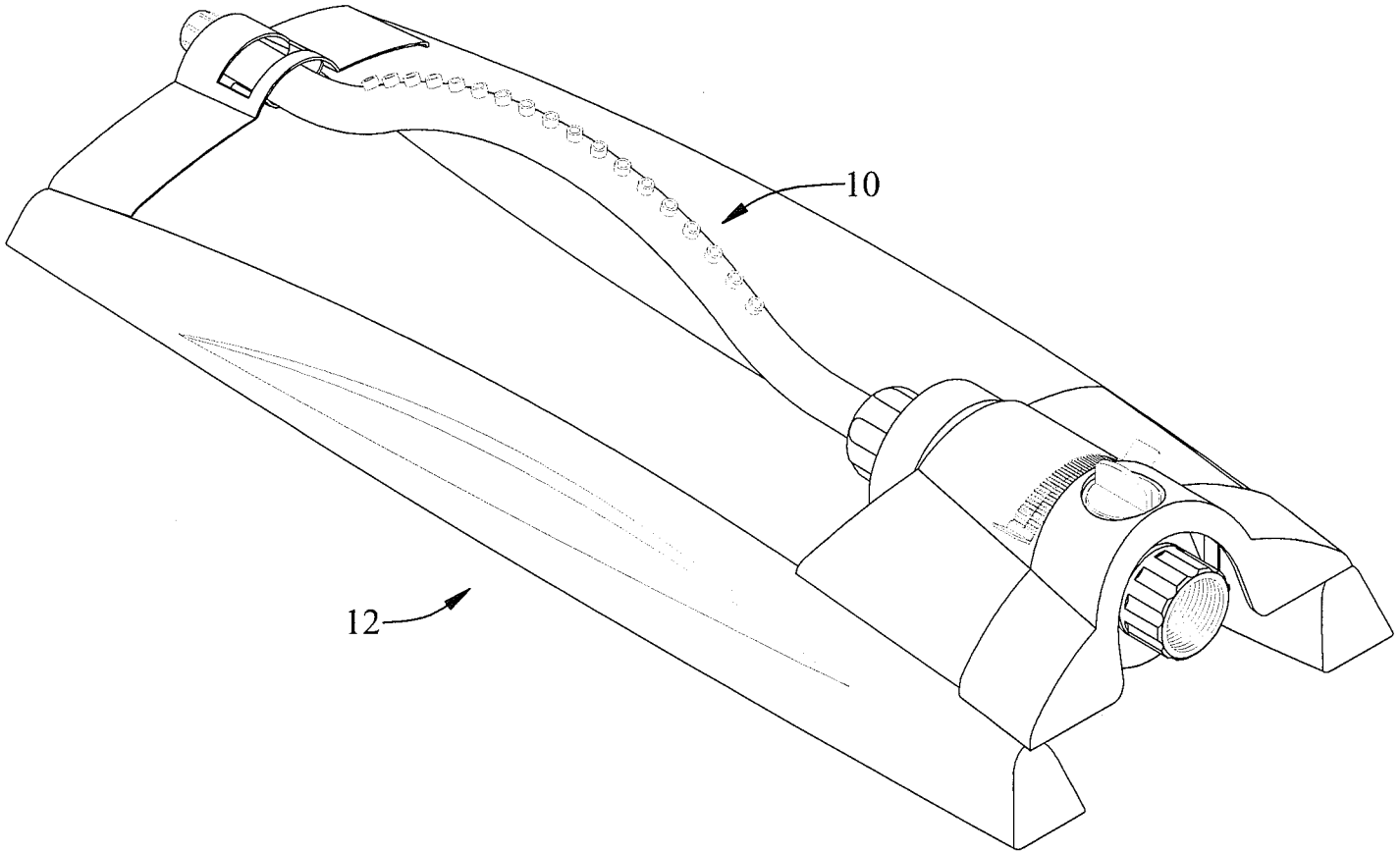
FIG. 1 is a perspective view of a sprinkler apparatus according to the preferred embodiment of the present invention.
Figure 2:
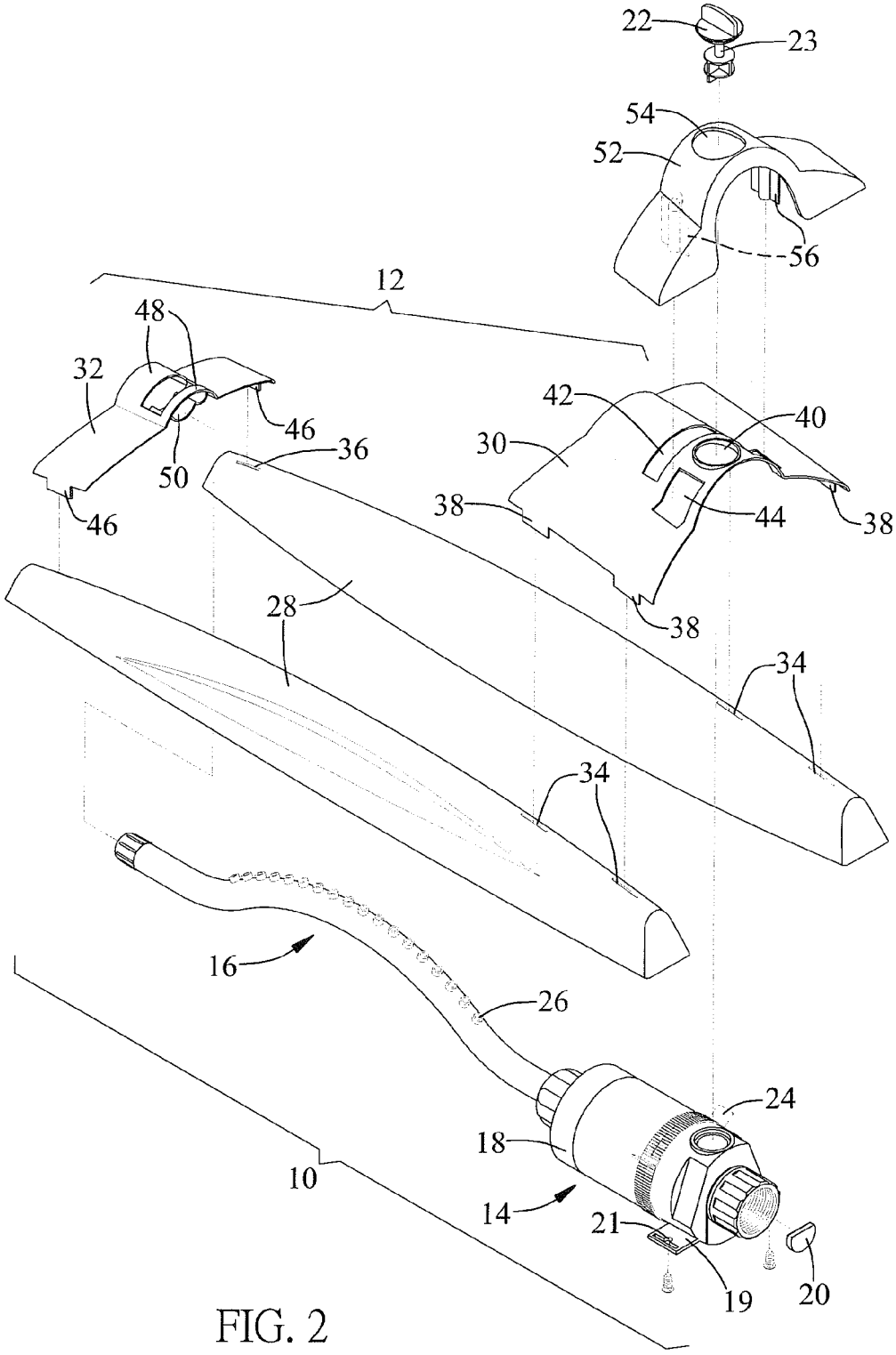
FIG. 2 is an exploded view of the sprinkler apparatus shown in FIG. 1.
Figure 3:
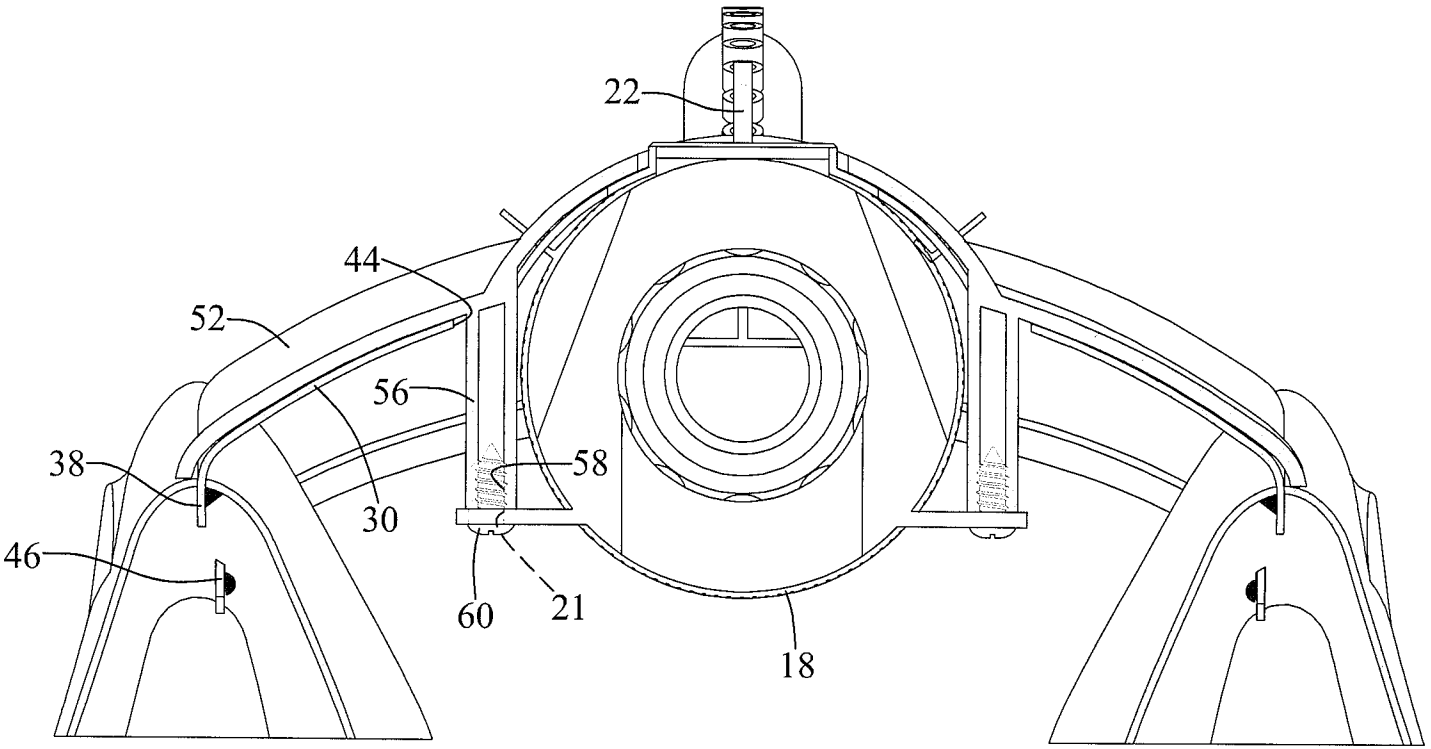
FIG. 3 is a cross-sectional view of the sprinkler apparatus shown in FIG. 1.

Referring to FIGS. 1 to 3, a sprinkler apparatus includes a sprinkler 10 and a frame 12 according to a preferred embodiment of the present invention. The sprinkler 10 is supported on the frame 12, which is generally placed on the ground, or sometimes, a wall in operation.

The sprinkler 10 includes a valve 14 and a tube 16. The valve 14 includes a valve housing 18, a valve element 20, a knob 22 and an axle 23. The valve housing 18 is made of a plastic material. The valve housing 18 is formed with two wings 19 each including an aperture 21.

The valve element 20 is made of a plastic material. The valve element 20 is pivotally placed in the valve housing 18.

The knob 22 is made of a plastic material. The knob 22 is placed out of the valve housing 18 and, hence, operable by a user.

The axle 23 is made of a plastic material. The axle 23 includes an end connected to the valve element 20 and another end connected to the knob 22. The valve element 20 can be pivoted by the knob 22 via the axle 23.

The tube 16 is made of metal. The tube 16 includes an arched middle portion extending between two rectilinear terminal portions that extend along a common axis. Nozzles 26 are evenly provided on the middle portion of the tube 16. The first terminal portion of the tube 16 is pivotally inserted in the valve housing 18. The second terminal portion of the tube 16 is pivotally inserted in a portion of the frame 12. The range of the pivoting of the first terminal portion of the tube 16 in the valve housing 18 is controlled by operating two limit elements 24 pivotally placed on the valve housing 18.

The frame 12 includes two symmetric lateral members 28 and first and second cross members 30 and 32. Each of the lateral members 28 is a hollow element made of a piece of metal by punching. Each of the lateral members 28 includes two slots 34 near an end and a slot 36 near another end.

The first cross member 30 is made of a piece of metal by punching. The first cross member 30 includes two lateral edges. Two fins 38 extend from each lateral edge of the first cross member 30. Furthermore, the first cross member 30 includes an aperture 40, a slot 42 and two openings 44. The aperture 40 is located between the openings 44.

The second cross member 32 is made of a piece of metal by punching. The second cross member 32 includes two lateral edges. A fin 46 extends from each lateral edge of the second cross member 32. The second cross member 32 further includes two upper strips 48 and a lower strip 50. The lower strip 50 is made by punching a portion of the second cross member 32 between the upper strips 48.

Preferably, the sprinkler apparatus further includes a panel 52. The panel 52 is made of a plastic material. The panel 52 includes an aperture 54. A pattern (not shown) may be provided on a side of the panel 52. The pattern is used to instruct the user to operate the knob 22 to pivot the valve element 20 in the valve housing 18. Two cylinders 56 are formed on an opposite side of the panel 52. Each of the cylinders 56 includes a screw hole 58.

As clearly shown in FIG. 3, the fins 38 are inserted in the slots 34, while the fins 46 are inserted in the slots 36. The fins 38 and 46 are secured to the lateral elements 28 by welding, for example.

The valve housing 18 is placed beneath the first cross member 30. The limit elements 24 are movable in the slot 42, so that the operation of the limit elements 24 is not hindered by the first cross member 30. The panel 52 is placed on the first cross member 30, with the cylinders 56 inserted in the openings 44. Two screws 60 are inserted in the screw holes 58 through the apertures 21. Thus, the valve housing 18 and the panel 52 are firmly connected to the first cross member 30.

The valve 20 is placed in the valve housing 18. The axle 23 is inserted in the apertures 54 and 40. An end of the axle 23 is connected to the valve 20, while the other end of the axle 23 is connected to the knob 22, which is placed above the panel 52.

The second terminal portion of the tube 16 is placed between the lower strip 50 and the upper strips 48. Thus, the tube 16 is only allowed to pivot about the common axis of the first and second terminal portions thereof.

Advantageously, the sprinkler apparatus is light and inexpensive, because the lateral members 28 and the first and second cross members 30 and 32 are hollow elements made of pieces of metal. Another reason for the low cost of the sprinkler apparatus is that the lateral members 28 and the first and second cross members 30 and 32 are made by punching, which is simpler and less expensive than casting. Furthermore, the sprinkler apparatus is aesthetically pleasant, since various coatings can be provided on the lateral members 28 and the first and second cross members 30 and 32.

The present invention has been described via the detailed illustration of preferred embodiments. Those skilled in the art can derive variations from the preferred embodiments without departing from the scope of the present invention. Therefore, the preferred embodiments shall not limit the scope of the present invention defined in the claims.

The invention claimed is:

1. A sprinkler apparatus comprising a sprinkler; and a frame for supporting the sprinkler, wherein the frame includes two lateral members and first and second cross members, with each of the first and second cross members including two lateral edges each connected to a corresponding one of the two lateral members, wherein the two lateral members and the first and second cross members are made of metal by punching, wherein the first cross member includes an aperture, wherein the sprinkler includes a valve and a tube connected to the valve, wherein the valve includes a valve housing placed beneath the first cross member, a valve element pivotally placed in the valve housing, a knob placed above the first cross member, and an axle inserted in the aperture and formed with an end connected to the valve element and another end connected to the knob.

2. The sprinkler apparatus according to claim 1, wherein the first and second cross members are secured to the two lateral members by welding.

3. The sprinkler apparatus according to claim 1, wherein each of the two lateral members includes a slot, wherein the first cross member includes a fin extending from each of the two lateral edges thereof, and wherein each fin is inserted in the slot of a corresponding one of the two lateral members.

4. The sprinkler apparatus according to claim 3, wherein the fins are secured to the two lateral members by welding.

5. The sprinkler apparatus according to claim 1, wherein each of the two lateral members includes a slot, wherein the second cross member includes a fin extending from each of the two lateral edges thereof, and wherein each fin is inserted in the slot of a corresponding one of the two lateral members.

6. The sprinkler apparatus according to claim 5, wherein the fins are secured to the two lateral members by welding.

7. The sprinkler apparatus according to claim 1, wherein each of the two lateral members includes first and second slots, wherein the first cross member includes a fin extending from each of the two lateral edges thereof, wherein the second cross member includes a fin extending from each of the two lateral edges thereof, wherein each fin of the first cross member is inserted in the first slot of a corresponding one of the two lateral members, and wherein each fin of the second cross member is inserted in the second slot of a corresponding one of the two lateral members.

8. The sprinkler apparatus according to claim 7, wherein the fins of the first and second cross members are secured to the two lateral members by welding.

9. The sprinkler apparatus according to claim 1, wherein the first cross member includes a slot, wherein the valve includes two limit elements pivotally placed on the valve housing and movably inserted in the slot of the first cross member.

10. The sprinkler apparatus according to claim 9, wherein the second cross member is formed with an upper strip and a lower strip, wherein the tube includes a portion restrained between the upper and lower strips.

11. The sprinkler apparatus according to claim 10, wherein the upper and lower strips are formed by punching.

12. The sprinkler apparatus according to claim 1, further including a panel placed between the knob and the first cross member, wherein the panel includes an aperture in which the axle is inserted.

13. The sprinkler apparatus according to claim 12, wherein the valve housing includes two wings each including an aperture, wherein the first cross member includes two openings, wherein the panel includes two cylinders each inserted in a corresponding one of the two openings and formed with a screw hole for receiving a screw inserted through the aperture of a corresponding one of the two wings of the valve housing.

* * * * *